US008608428B2

(12) United States Patent
Andersson

(10) Patent No.: US 8,608,428 B2
(45) Date of Patent: Dec. 17, 2013

(54) SUBMERSIBLE CENTRIFUGAL PUMP WITH NORMAL AND EJECTOR MODES OF OPERATION

(75) Inventor: Patrik Andersson, Skogås (SE)

(73) Assignee: Xylem IP Holdings LLC, White Plains, NY (US)

( * ) Notice: Subject to any disclaimer, the term of this patent is extended or adjusted under 35 U.S.C. 154(b) by 1067 days.

(21) Appl. No.: 12/598,123

(22) PCT Filed: May 12, 2008

(86) PCT No.: PCT/SE2008/050547

§ 371 (c)(1),
(2), (4) Date: Oct. 29, 2009

(87) PCT Pub. No.: WO2009/020420

PCT Pub. Date: Feb. 12, 2009

(65) Prior Publication Data

US 2010/0119365 A1 May 13, 2010

(30) Foreign Application Priority Data

May 15, 2007 (SE) ..... 0701166

(51) Int. Cl.
*F04D 27/00* (2006.01)

(52) U.S. Cl.
USPC ..... 415/26; 415/48; 415/127; 415/128

(58) Field of Classification Search
USPC ..... 417/423.14, 423.15; 415/121.1, 121.2, 415/126, 127, 128, 225, 129, 131, 132, 48, 415/26; 60/336
See application file for complete search history.

(56) References Cited

U.S. PATENT DOCUMENTS

| | | | | |
|---|---|---|---|---|
| 5,044,566 | A * | 9/1991 | Mitsch | 241/46.04 |
| 6,599,086 | B2 * | 7/2003 | Soja | 415/128 |
| 7,168,915 | B2 * | 1/2007 | Doering et al. | 415/121.1 |

FOREIGN PATENT DOCUMENTS

| | | |
|---|---|---|
| DE | 41 42 120 | 6/1993 |
| FR | 88.170 | 12/1966 |
| GB | 2 166 800 | 5/1986 |
| WO | WO 2007/004943 | 1/2007 |

* cited by examiner

*Primary Examiner* — Edward Look
*Assistant Examiner* — Aaron R Eastman
(74) *Attorney, Agent, or Firm* — RatnerPrestia

(57) ABSTRACT

The present invention relates to a submersible centrifugal pump assembly comprising an impeller suspended in the end of a drive shaft, and driven in rotation relative to an impeller seat which is stationary in normal operation and which defines an axial intake for liquid to be transported by the impeller in rotation. The pump assembly is characterized in that the impeller seat is journalled in a pump housing for limited rotational movements in opposite directions of rotation relative to the pump housing, and in rotation controlled in guide means for limited linear displacements in opposite axial directions relative to the impeller.

24 Claims, 3 Drawing Sheets

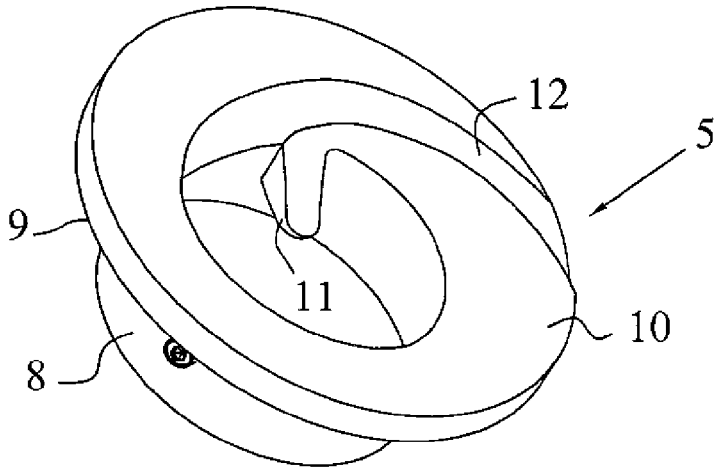
Fig. 3
Fig. 4
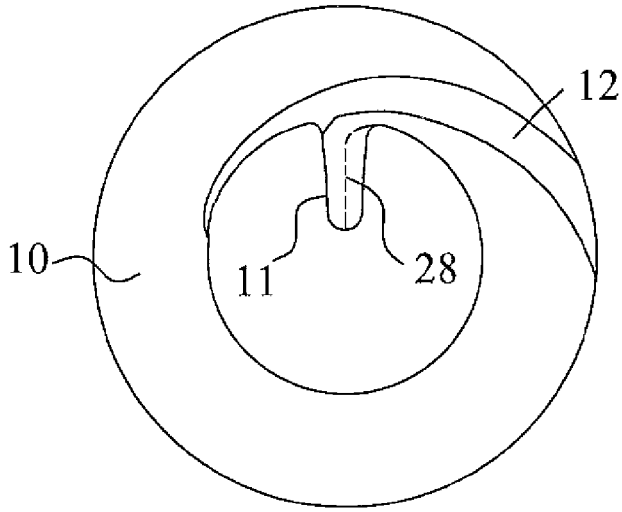
Fig. 5
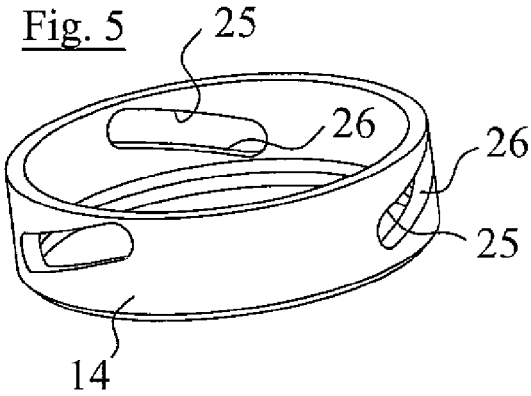

SUBMERSIBLE CENTRIFUGAL PUMP WITH NORMAL AND EJECTOR MODES OF OPERATION

This application is the U.S. national phase application of PCT International No. PCT/SE2008/050547, filed May 12, 2008, which claims priority to Swedish Patent Application No. 0701166-1, filed May 15, 2007, the contents of such patents being incorporated by reference herein.

TECHNICAL FIELD OF INVENTION

The present invention relates to pumps for the transport of liquids or slurries containing solid matter entrained in the liquid or slurry. More specifically, the invention relates to submersible centrifugal pumps wherein means are provided for ejection of solids that would obstruct the normal operation of the pump.

BACKGROUND AND PRIOR ART

Submersible pumps find many uses wherein liquid or slurry containing solid matter needs transporting, such as in mining, at building sites, in the treatment of waste or sewage, in flooded land areas, etc. A typical submersible pump that is used in these applications is the centrifugal pump wherein liquid transport is generated by an impeller pump wheel in rotation, sucking liquid and any solid matter entrained therein through an axial inlet on the suction side of the pump, and accelerating the liquid and solid matter through centrifugal action via a radial discharge on the pressure side of the pump. The literature contains numerous embodiments of the centrifugal pump which is well known to the public.

The literature also contains several examples of pump solutions by which solid matter entrained in liquid is cut down to fractions, the size of which this way is adapted to pass through the pump without obstructing its operation. Obviously this method applies only to solid matter that is possible to cut in a shearing action, generated typically by means of elements in relative rotation as the pump is operating.

Submersible pumps are however also applied in connection with liquids and slurry containing hard solid matter that is not suitable for cutting, such as minerals, metal, hard wood and synthetics. In applications where hard solid matter is not screened or otherwise extracted from the liquid, the pump needs to be structured to admit the solids to pass through the pump. Any measure to this purpose which includes the provision of permanent gaps between rotary and stationary components of the pump will hamper the pump's capacity, and will not completely avoid the risk of extraordinary sized solids getting wedged between the components in relative rotation.

WO 2007/004943 A1 suggests another approach to this problem. A submersible centrifugal pump is disclosed and structured to effect ejection of solids that would potentially obstruct the operation of the pump. An impeller is keyed to the end of a drive shaft through a coupling that permits the impeller to be displaced axially relative to an impeller seat at the pump intake. A solid of a size that may not be propelled through the pump in normal operation will cause the impeller to lift from the impeller seat, forming a gap there between through which the solid is ejected into the discharge flow. The impeller is then caused by the pressure difference over the impeller to return to its normal operation in close rotation to the impeller seat.

Although the operation is satisfactory as expected, improvements of the ejector function are still possible.

SUMMARY OF INVENTION

The present invention thus aims to improve the ejector function in a submersible centrifugal pump.

The object is met in a pump assembly as defined in claim 1. Embodiments of the invention are further defined in the subordinate claims.

Briefly, a pump assembly according to the present invention comprises an impeller suspended in the end of a drive shaft, and driven in rotation relative to an impeller seat which is stationary in normal operation and which defines an axial intake for liquid to be transported by the impeller in rotation. The pump assembly is characterized in that the impeller seat is journalled in a pump housing for limited rotational movements in opposite directions of rotation relative to the pump housing, and in rotation controlled by guide means for limited linear displacements in opposite axial directions relative to the impeller.

The impeller seat is linearly displaceable in a first axial direction from the impeller in result of its rotation with the impeller in a first direction of rotation, and linearly displaceable in a second axial direction towards the impeller in result of its rotation in a second direction of rotation against the impeller rotation.

The impeller seat is indirectly driven by the impeller for rotation in the first direction of rotation. Rotation of the impeller seat in the second direction of rotation is generated from a bias applied to the impeller seat.

The impeller seat may be biased in the second direction of rotation by spring force, provided from elastic elements acting between the impeller seat and the pump housing. Elastic elements may be arranged to apply, in the circumferential direction of the impeller seat, a bias which effects a rotation of the impeller seat in the second direction of rotation, in result of which the impeller seat is returned to its normal operational position. Alternatively, spring elements may be arranged to apply, in the axial direction of the impeller seat, a bias which effects a linear displacement by which the impeller seat is returned to its normal operational position under rotation in the second direction of rotation.

The impeller seat may alternatively be biased in the second direction of rotation through the kinetic energy of liquid flowing through the impeller seat in operation of the pump. To this purpose the impeller seat is internally formed with flow directing surfaces.

Preferably, the impeller seat is journalled in the pump housing, directly or indirectly, through at least two guide means positioned at equidistant angular spacing about the circumference of the impeller seat. Even more preferred, three guide means are disposed about the circumference at equidistant angular spacing.

In the illustrated embodiment, exemplifying the invention, the guide means is realized as combinations of guide pins and recesses. The guide pins may project in radial directions from a cylinder wall of the impeller seat for engagement in corresponding recesses formed in a cylinder wall of the pump housing, or in a guide ring mounted in the pump housing in concentric relation with the impeller seat. Alternatively, the guide pins may project from the pump housing towards a centre for engagement in corresponding recesses that are formed externally on the impeller seat.

The guide pins may be realized as low-friction pins which are received to slide in the corresponding recesses. Alternatively, the guide pins are formed as idling rollers which are received to travel along upper and lower walls of the corresponding recesses. As used herein, "upper" refers to a downstream location as seen in the flow direction during operation of the submersible pump.

The recesses comprise guiding walls that extend at an angle relative to a radial plane intersecting at right angles the longitudinal centre of the impeller seat. Each recess preferably has a limited length in the circumferential direction of the interface between impeller seat and pump housing. In one embodiment, each recess is the general shape of a slot with semi-circular ends connecting upstream and downstream walls in parallel relation. The guiding walls may be rectilinear or curved, or combinations thereof, when translated to a planar view. In curved recesses, the centre of curvature is preferably located upstream of the recess as seen in the flow direction of liquid through the impeller seat.

A guide means may alternatively be realized as mutually engaging coiled formations or threads formed on opposite surfaces of the impeller seat and pump housing, or on opposite surfaces of the impeller seat and a separate guide ring, respectively.

Preferably two, or even more preferred three coiled formations or threads are formed at equidistant angular spacing about the circumference of the impeller seat and the guide ring, respectively. If appropriate, threads may be continuous or segmented, having thread starts located at equidistant angular spacing about the circumference of the impeller seat and the guide ring, respectively.

SHORT DESCRIPTION OF THE DRAWINGS

The invention is further explained below with reference to the drawings, illustrating embodiments of the invention. In the drawings, FIG. 1 is a partially sectioned perspective view showing an embodiment of a pump assembly according to the present invention in a normal mode of operation;

FIG. 3 is a perspective view showing an impeller seat forming part of the pump assembly;

FIG. 4 is a planar top view of the impeller seat of FIG. 3;

FIG. 5 is a perspective view showing an impeller seat guide ring forming part of a preferred embodiment of the pump assembly.

DETAILED DESCRIPTION OF THE INVENTION

Figure 1:
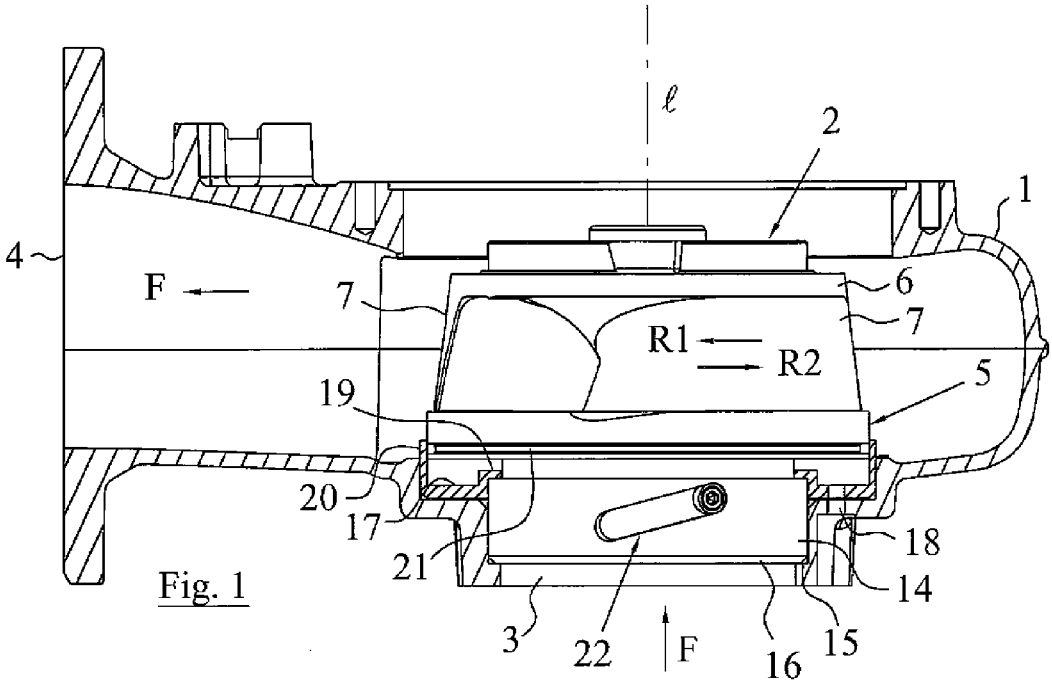

Referring initially to FIG. 1, a centrifugal pump assembly is comprised in a pump housing 1. Liquid flow through the pump housing is generated by an impeller pump wheel 2 which is keyed to the end of a drive shaft (not shown) that is journalled in the pump housing for rotation and driven by a motor (also not shown). Upon rotation as indicated by arrow R1, the impeller 2 generates centrifugal forces that causes a liquid, wherein the pump is submerged, to enter the pump via an axial intake 3 on the suction side of the pump for acceleration through a radial discharge 4 which communicates with further conduits (not shown) on the pressure side of the pump. In FIG. 1, the flow direction of liquid is indicated by arrows F.

The impeller 2 is driven for rotation relative to an impeller seat 5. From an upper disc 6, impeller vanes 7 are supported for rotation in close vicinity to an upper perimeter region of the impeller seat in the normal mode of operation as depicted in FIG. 1.

Momentarily turning to FIG. 3, the impeller seat 5 is a generally rotation symmetric member comprising a cylinder portion 8 connecting to the upstream side of a flange member 9. An upper perimeter region 10, which faces the impeller in operation, may be shaped as illustrated in correspondence to a compound curvature applied to the vanes 7. Advantageously, a guiding finger 11 projecting into the flow of liquid through the impeller seat, as well as an exit groove 12 formed in the upper perimeter region, may be arranged and active for discharge of solid matter that enters the impeller seat via the pump intake.

Returning to FIG. 1, the impeller seat 5 is mounted in the pump housing and stationary in normal operation. However, in accordance with the present invention, the impeller seat is movable in relation to the impeller between the position that is depicted in FIG. 1, corresponding to a normal operational mode, and a lowered position depicted in FIG. 2 corresponding to an ejection mode of operation. In the lowered position of the impeller seat, as readily visible in FIG. 2, an axial gap 13 is established between the impeller seat and the impeller. Solids too big to pass between the impeller and impeller seat, via the exit groove 12 if appropriate, in the normal operational mode will eject into the liquid flow via the gap in the ejection mode of operation.

As will be further explained below, ejection mode is initialized by solid matter mechanically engaging the impeller seat and the impeller rotating in relation thereto. Basically, in accordance with the present invention, a pump assembly is provided with an impeller seat in cooperation with an impeller, the impeller seat being supported in a pump housing for a limited displacement relative to the impeller. The displacement comprises rotational and axial components of motion.

Specifically, the ejection mode of operation is realized by the impeller seat 5 being journalled in the pump housing 1 for limited rotational movements in opposite directions of rotation R1, R2 relative to the pump housing, and in rotation controlled by guide means for limited linear displacements in opposite axial directions A1, A2 relative to the impeller 2. In this connection, "linear" refers to an axial displacement of a geometrical centre of the impeller seat 5.

Figure 2:
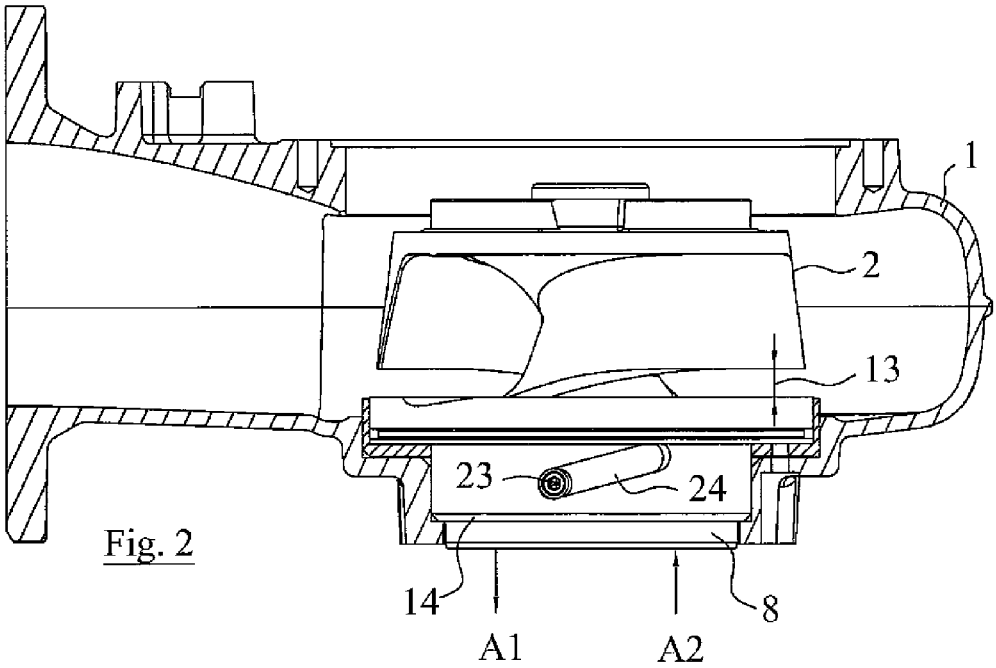
FIG. 2 is a view corresponding to FIG. 1, showing the pump assembly in ejection mode.

To this purpose, the impeller seat 5 may be journalled in a guide ring 14 which is stationary supported in the pump housing in concentric relation to the cylinder portion 8 of the impeller seat 5. In the embodiment of FIGS. 1 and 2, the guide ring 14 is clamped between a circular shoulder 15 which is formed on the pump housing and which supports a lower end 16 of the guide ring, and a clamping ring 17 bolted to the pump housing at 18 and supporting the guide ring by means of a flange 19 which engages the upper end of the guide ring. A cylindrical skirt member 20 rises from the clamping ring 17 in close concentric relation about the outer periphery of impeller seat flange 9, the latter advantageously comprising a circumferential seat 21 for insertion of a ring seal (not shown).

For a jam-free axial displacement of the impeller seat 5, a guide means is arranged at the interface between the impeller seat 5 and the guide ring 14. By structure and operation of such guide means the impeller seat is linearly displaceable in a first axial direction A1 from the impeller in result of its rotation with the impeller in a first direction of rotation R1, and linearly displaceable in a second axial direction A2 towards the impeller in result of its rotation in a second direction of rotation R2 against the impeller rotation.

A guide means may be alternatively structured to provide a jam-free movement of the impeller seat 5. In one conceivable embodiment a guide means is realized as a coil-shaped formation at the interface between the impeller seat and the guide ring. A coil-shaped guide means may be formed as a singular and continuous trapezoidal thread, e.g. Alternatively, a coil or thread formation may be segmented to include at least two portions of limited circumferential length, and in this case preferably arranged at equidistant angular spacing about the circumference of the impeller seat and guide ring, respectively. Even more preferred, a plural guide means include three guiding formations arranged at equidistant angular spacing about the circumference. Another conceivable embodiment includes plural, such as two or three, segmented or continuous threads having thread starts located at equidistant angular spacing about the circumference. Also conceivable, a singular or plural guide means may include any appropriate combination of engaging threads, grooves, heels, etc., known to a person skilled in the art as elements of bayonet couplings, e.g.

In the illustrated embodiment, three guide means 22 are positioned at equidistant angular spacing about the circumference of the impeller seat 5. The guide means 22 is realized as combinations of guide pins 23 and recesses 24. As illustrated, the guide pins may project in radial directions from the wall of cylinder portion 8 of the impeller seat for engagement in corresponding recesses formed in the cylinder wall of the guide ring 14. Alternatively, though not shown in drawings, recesses may instead be formed in the pump housing in embodiments wherein the guide ring is omitted, if appropriate. Guide pins may alternatively project from the pump housing, or from the guide ring 14, towards a longitudinal centre of the pump intake for engagement in corresponding recesses that are formed externally on the impeller seat cylinder portion 8 (also not illustrated).

The guide pins 23 may be realized as low friction pins which are received to slide in the corresponding recesses 24. Alternatively, the guide pins may be formed as idling rollers which are received to travel along upper and lower walls 25 and 26, respectively, of the corresponding recesses.

Turning now to the embodiments shown in FIGS. 5 and 6 of the drawings. Each recess 24 may comprise guiding walls 25 and 26 that extend generally at an angle $\alpha$ relative to a radial plane r intersecting at right angles the longitudinal centre/of the guide ring 14. The angle $\alpha$ may vary, but is distinct from a zero angle and a 90° angle. A preferred range of angle $\alpha$ is 5 to 45°. However, angles more than 45° may be applicable, as well as angles $\alpha$ that vary in the length direction of the recess, in case of a recess 24 that, e.g., has a curved general extension as illustrated in FIGS. 6*b*-6*d*.

Figure 6A:
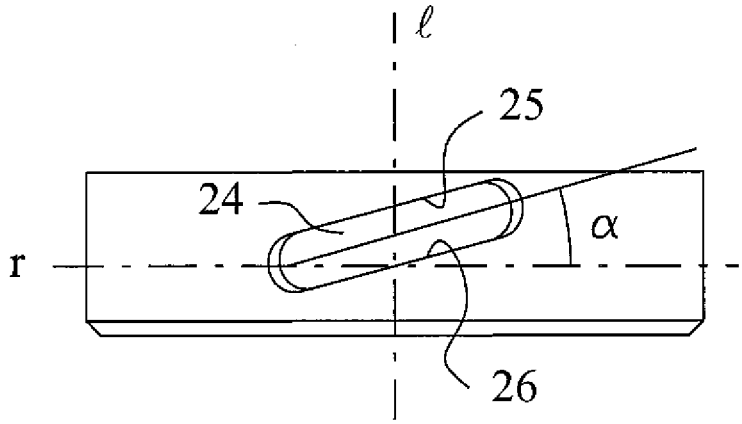
FIGS. 6*a*, 6*b*, 6*c* and 6*d* are elevation views of guide rings comprising alternative embodiments of a guide means incorporated in the pump assembly.
Figure 6B:
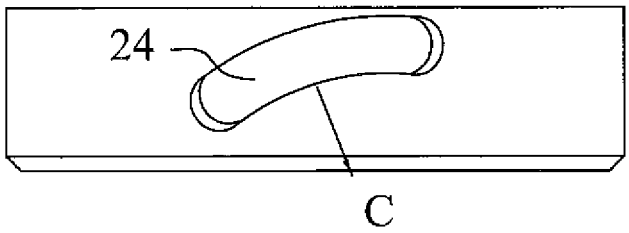
Figure 6C:
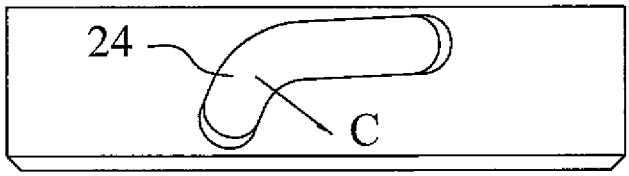
Figure 6D:
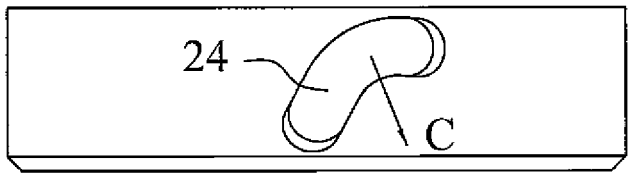

Each recess preferably has a limited length in the circumferential direction of the guide ring. Preferably, the combined length of all recesses does not exceed half the circumference of the guide ring 14. In the embodiment of FIG. 4, each recess is the general shape of a slot 24 through the wall of the guide ring. The slot-shaped recess 24 has semi-circular ends connecting upper and lower walls 25, 26 in parallel relation. Translated to the planar view, the walls may be rectilinear as illustrated in FIG. 6*a*, or curved as illustrated in FIGS. 6*b*-6*d*. In a curved recess the centre C of curvature is preferably located upstream of the curvature or of the recess, as seen in the flow direction of liquid. Combinations of curved and rectilinear portions of the recesses/guiding walls are possible as illustrated in FIGS. 6*c* and 6*d*.

Alternatively, one of the guiding walls in a recess may be rectilinear and the other wall curved, the curved wall being either the upper or the lower wall.

Feasible modifications to the guide means include shallow recesses that extend for limited radial depth into the material of the guide ring, or into the material of pump housing if applicable, or into the outer surface of the cylinder portion 8 of the impeller seat if appropriate.

As explained above, the impeller seat 5 is indirectly driven by the impeller for rotation with the impeller in the first direction of rotation R1 in result of a solid mechanically engaging the two elements. Rotation of the impeller seat in the second direction of rotation R2 is however generated from a bias applied to the impeller seat. To this purpose, the impeller seat may be biased in the second direction of rotation by spring force provided from elastic members acting between the impeller seat 5 and the guide ring 14, or the pump housing 1 in case the guide ring is omitted as discussed above. The elastic members are arranged to apply, in the circumferential direction of the impeller seat, a bias which effects a rotation of the impeller seat in the second direction of rotation R2, in result of which the impeller seat is returned to its normal operational position. It will be appreciated, though not visible in the drawings, that elastic members or springs may be realized, e.g., in the form of one or several extendable or compressible elements which are inserted at the interface between the impeller seat and the guide ring, one end of said elastic element or spring affixed to the impeller seat and the other end thereof affixed to the guide ring.

Elastic elements or springs may alternatively be arranged to apply, in the axial direction of the impeller seat, a bias which effects a linear displacement by which the impeller seat is returned to its normal operational position under rotation in the second direction of rotation R2. Although not visible in the drawings, it will be appreciated that a lower end of such elastic element or spring may be inserted into the pump housing or into the guide ring, acting with an upper end thereof against the upstream face of the flange 9 of the impeller seat.

Alternatively, the impeller seat may be biased in the second direction of rotation R2 through the kinetic energy of liquid flowing through the impeller seat in operation of the pump. To this purpose the impeller seat may be formed internally with at least one flow directing surface, such as the slanting surface 28 indicated with broken line in FIG. 4.

Modification of details that are not part of the invention, and for this reason are not further discussed herein, are possible within the scope of appended claims which also embrace modifications to the invention as disclosed by way of example and which are derivable there from.

The invention claimed is:

1. A pump assembly comprising an impeller suspended in the end of a drive shaft, and driven in rotation relative to an impeller seat which is stationary in normal operation and which defines an axial intake for liquid to be transported by the impeller in rotation, the impeller seat journalled in a pump housing by guide means that during an ejection mode of operation permit rotational movements in opposite directions of rotation relative to the pump housing and linear displacements in opposite axial directions relative to the impeller.

2. The pump assembly of claim 1, wherein the impeller seat is linearly displaced in a first axial direction from the impeller in result of its rotation with the impeller in a first direction of rotation, and linearly displaced in a second axial direction towards the impeller in result of its rotation in a second direction of rotation opposite the impeller rotation.

3. The pump assembly of claim 2, wherein the impeller seat is indirectly driven by the impeller for rotation in the first direction of rotation, whereas rotation of the impeller seat in the second direction of rotation is generated from a bias applied to the impeller seat.

4. The pump assembly of claim 3, wherein the impeller seat is biased in the second direction of rotation by spring force, provided from elastic elements.

5. The pump assembly of claim 4, wherein elastic elements are arranged to apply, in the circumferential direction of the impeller seat, a bias which effects a rotation of the impeller seat in the second direction of rotation, in result of which the impeller seat is returned to its normal operational position.

6. The pump assembly of claim 4, wherein elastic elements are arranged to apply, in the axial direction of the impeller seat, a bias which effects a linear displacement by which the impeller seat is returned to its normal operational position under rotation in the second direction of rotation.

7. The pump assembly of claim 3, wherein the impeller seat is internally formed with at least one flow directing surface by which the impeller seat is biased in the second direction of rotation through the kinetic energy of liquid flowing through the impeller seat in operation of the pump.

8. The pump assembly of claim 1, wherein the impeller seat is journalled in the pump housing, directly or indirectly, through at least two guide means positioned at equidistant angular spacing about the circumference of the impeller seat.

9. The pump assembly of claim 8, wherein three guide means are disposed at equidistant angular spacing about the circumference of the impeller seat.

10. The pump assembly of claim 9, wherein the guide means is realized as a combination of guide pin and recess.

11. The pump assembly of claim 10, wherein the guide pins project in radial directions from the external periphery of the impeller seat to engage in corresponding recesses formed internally in the pump housing, or formed internally in a separate guide ring mounted to the pump housing in concentric relation about the impeller seat.

12. The pump assembly of claim 10, wherein the guide pins project from the internal periphery of the pump housing in radial directions towards a longitudinal centre to engage in corresponding recesses formed externally on the impeller seat.

13. The pump assembly of claim 10, wherein the guide pins are realized as low-friction pins which are received to slide on upper and lower guiding walls of the corresponding recesses.

14. The pump assembly of claim 10, wherein the guide pins are realized as idling rollers which are received to travel along upper and lower guiding walls of the corresponding recesses.

15. The pump assembly of claim 10, wherein each recess extends at limited circumferential length and at an angle relative to a radial plane intersecting at right angles the longitudinal centre of the impeller seat.

16. The pump assembly of claim 15, wherein the recess is, the general shape of a slot with semi-circular ends connecting upstream and downstream guiding walls in parallel relation.

17. The pump assembly of claim 15, wherein the recess is the general shape of a slot with semi-circular ends connecting upstream and downstream guiding walls, at least one of which is curved or has a curved portion of its length.

18. The pump assembly of claim 17, wherein a centre of curvature in a curved recess, or in a partially curved recess, is located on the upstream side of the recess as seen in the flow direction of liquid through the impeller seat.

19. The pump assembly of claim 10, wherein the recesses are formed as through slots.

20. The pump assembly of claim 10, wherein the recesses are formed as shallow slots.

21. The pump assembly of claim 10, wherein the guide pins project from the internal periphery of a separate guide ring mounted to the pump housing in concentric relation about the impeller seat in radial directions towards a longitudinal centre to engage in corresponding recesses formed externally on the impeller seat.

22. The pump assembly of claim 1, wherein the guide means is realized as mutually engaging coiled formations or threads formed on opposite surfaces of the impeller seat and pump housing, or on opposite surfaces of the impeller seat and a separate guide ring, respectively.

23. The pump assembly of claim 22, wherein at least two coiled formations or threads are formed at equidistant angular spacing about the circumference of impeller seat and guide ring, respectively.

24. The pump assembly of claim 23, wherein the threads are continuous or segmented, having thread starts located at equidistant angular spacing about the circumference of impeller seat and guide ring, respectively.

* * * * *